US006518941B1

(12) United States Patent
Kimura

(10) Patent No.: US 6,518,941 B1
(45) Date of Patent: Feb. 11, 2003

(54) DISPLAY DEVICE

(75) Inventor: Mutsumi Kimura, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/297,263

(22) PCT Filed: Aug. 25, 1998

(86) PCT No.: PCT/JP98/03756

§ 371 (c)(1),
(2), (4) Date: Apr. 28, 1999

(87) PCT Pub. No.: WO99/12150

PCT Pub. Date: Mar. 11, 1999

(30) Foreign Application Priority Data

Aug. 28, 1997 (JP) ..... 9-233107

(51) Int. Cl.[7] ..... G09G 3/20

(52) U.S. Cl. ..... 345/55; 345/7; 345/76; 345/77; 345/80; 345/90; 345/92; 345/214; 315/169.3

(58) Field of Search ..... 315/169.3; 345/7, 345/76, 77, 80, 90, 92, 214, 55

(56) References Cited

U.S. PATENT DOCUMENTS 5,543,819 A * 8/1996 Farwell et al. ..... 345/150
5,548,305 A * 8/1996 Rupel ..... 345/150

(List continued on next page.)

FOREIGN PATENT DOCUMENTS

| | | |
|---|---|---|
| EP | 0 653 741 A1 | 5/1995 |
| EP | 0 762 374 A1 | 3/1997 |
| FR | 2 582 431 | 11/1986 |
| JP | 56-88193 A | 7/1981 |
| JP | A-56-88193 | 7/1981 |
| JP | A-58-220185 | 12/1983 |
| JP | A-61-22326 | 1/1986 |
| JP | 61-022326 A | 1/1986 |
| JP | A-6-325869 | 11/1994 |
| JP | A-7-235378 | 9/1995 |
| JP | A-8-54835 | 2/1996 |
| JP | A-8-241057 | 9/1996 |
| JP | A-9-153624 | 6/1997 |

OTHER PUBLICATIONS

"Half–Tone Methods for Passive–Matrix–Addressed Displays: LCD and Actfel", IBM Technical Disclosure Bulletin, US, IBM Corp., vol. 33, No. 8, Jan. 1991, pp. 411–413.

"Circuitry to Address Field Effect Electroluminescent Panel", IBM Technical Disclosure Bulletin, US, IBM Corp., vol. 13, No. 4, Sep. 1970, pp. 967–968.

"MOS–EL Integrated Display Device", SID International Sympsium, US, Coral Gables, Winner, Vo. SYMP. May 13, 1982, pp. 266–267.

"Active Matrix CDSE TFT Addressed Electroluminescent Displays", International Display Research Conference, US, New York, IEEE, Oct. 1988, pp. 74–99.

*Primary Examiner*—Bipin Shalwala
*Assistant Examiner*—Vincent E. Kovalick
(74) *Attorney, Agent, or Firm*—Oliff & Berridge, PLC.

(57) ABSTRACT

In a display device in accordance with the present invention, each pixel includes a plurality of luminescent elements having different luminous intensities to represent gray scales by controlling the turning ON/OFF of the luminescent elements. A digital signal is transmitted to each pixel to carry out control by thin film transistors connected in series with the luminescent elements. The luminous intensities of the luminescent elements are the geometric progressions of a common ratio of 2. The ON resistance of the thin film transistors is set to be lower than the ON resistance of the luminescent elements, while the OFF resistance of the thin film transistors is set to be higher than the OFF resistance of the luminescent elements. These features have reduced the nonuniformity in the luminous intensities of the luminescent elements caused by the nonuniformity in the conductance of the transistors, thus achieving improved image quality.

11 Claims, 6 Drawing Sheets

U.S. PATENT DOCUMENTS 5,652,600 A * 7/1997 Khormaei et al. ..... 345/76
5,682,052 A * 10/1997 Hodges et al. ..... 257/377
5,754,064 A * 5/1998 Chien ..... 315/169.3
5,786,796 A * 7/1998 Takayama et al. ..... 345/76
5,821,913 A * 10/1998 Mamiya ..... 345/88
5,895,692 A * 4/1999 Shirasaki et al. ..... 427/557
5,940,053 A * 8/1999 Ikeda ..... 345/77
6,057,647 A * 5/2000 Kurosawa et al. ..... 315/169.3
6,114,183 A * 9/2000 Hamada et al. ..... 438/29
6,140,980 A * 10/2000 Spitzer ..... 345/8

* cited by examiner

DISPLAY DEVICE

BACKGROUND OF THE INVENTION

1. Field of the Invention

The present invention relates to a display device equipped with a display element and, more particularly, to a display device equipped with an element that emits light by means of a thin film transistor and current (hereinafter referred to as a "current luminescent display device".

2. Description of the Related Art

A thin film transistor organic electroluminescent device (hereinafter referred to as "TFT-OELD") may be cited as a highly promising future current luminescent display device that realizes a larger size, higher definition, a wider viewing angle, and reduced power consumption.

A method for driving a typical conventional TFT-OELD will be described.

FIG. 5 shows an equivalent circuit of the conventional TFT-OELD. Only one pixel is shown in the drawing although there are actually many pixels in a plurality of rows and a plurality of columns.

A pulse is output from a shift register 101, and an analog signal of an analog signal supply line 1022 is transmitted to a source line 1042 via a transmission switch 1032. For a gate line 109 that has been selected this time, the analog signal is transmitted to a retention capacitor 1062 via a switching transistor 1052. The conductance of a current transistor 1072 is controlled in accordance with the analog signal, and an organic EL element 1082 emits light of an intensity level based on the analog signal.

FIG. 6 illustrates the conventional TFT-OELD driving method.

A pulse SR0 of a shift register of a zero-th column causes an analog signal A to be transmitted to a potential S0 of a source line of a zero-th column. Further, a pulse SR1 of a shift register of a first column causes the analog signal A to be transmitted to a potential S1 of a source line of the first column. First, while a pulse G0 of a gate line of the zero-th row is being applied, the potential S0 of the source line of the zero-th column is transmitted to a potential C00 of a retention capacitor of the zero-th row and the zero-th column, whereas the potential S1 of the source line of the first column is transmitted to a potential C01 of a retention capacitor of the zero-th row and the first column. Then, while a pulse G1 of a gate line of the first row is being applied, the potential S0 of the source line of the zero-th column is transmitted to a potential C10 of a retention capacitor in the first row and the zero-th column, whereas the potential S1 of the source line of the first column is transmitted to a potential C11 of a retention capacitor in the first row and the first column. Each organic EL element 1082 (FIG. 5) emits light of a predetermined intensity level in accordance with the potential of each retention capacitor 1062 (FIG. 5), i.e., the corresponding analog signal A.

An area gray scale method is known as one of the driving methods of a liquid crystal display device. In general, a liquid crystal display device has a problem of a limited viewing angle range due to a marked change in the transmissivity or the reversal of gray scale in a direction of a viewing angle that deviates from the direction of the normal line with respect to a display surface. The foregoing area gray scale method is intended to solve the problem, and it is adapted to represent a gray scale in terms of an area ratio of full transmission to no transmission. This realizes a wider viewing angle range of a liquid crystal display device.

According to the conventional TFT-OELD driving method mentioned above, the analog signals are used to control the conductance of the current transistor 1072 so as to control the luminous intensity of the organic EL element 1082. In other words, to obtain a half tone, the conductance of the current transistor 1072 must be set to be equal to the conductance of the organic EL element 1082, and the voltage applied to the organic EL element 1082 must be controlled by dividing the voltages of the current transistor 1072 and the organic EL element 1082. In such a case, however, there has been a problem in that, if nonuniformity in the conductance of the current transistor 1072 should be produced within a panel or between panels, then the nonuniform conductance will be visually recognized in the form of nonuniform luminous intensity of the organic EL element 1082.

SUMMARY OF THE INVENTION

Accordingly, an object of the present invention is to reduce the nonuniformity in the luminous intensity of a luminescent element (an organic EL element in particular) caused by the nonuniformity in the conductance of transistors in a current luminescent display device, particularly in a TFT-OELD, thereby to improve image quality.

A display device in accordance with the present invention has the following configuration.

The display device has a plurality of scanning lines, a plurality of signal lines, and a pixel formed in a matrix pattern by the scanning lines and the signal lines, a plurality of thin film transistors and a plurality of luminescent elements being formed in the pixel;

wherein the thin film transistors and the luminescent elements are respectively connected in series, and the luminous intensities of the respective luminescent elements are different.

This permits the gray scale method to be implemented, in which each of the luminescent elements having the different luminous intensities is controlled to be placed in either a completely ON state or a completely OFF state. With this arrangement, the nonuniformity in the luminous intensity of the luminescent elements caused by the nonuniformity in the conductance of the thin film transistors can be reduced.

In the present invention, the turning ON/OFF of the luminescent elements are preferably controlled by digital signals. This makes it possible to control each of a plurality of luminescent elements having a different luminous intensity in each pixel so as to place it in either the completely ON state or the completely OFF state.

In the present invention, the luminous intensities of the luminescent elements are preferably the geometric progressions of a common ratio of 2. This will provide each pixel with a DA converter, making it possible to obtain the luminous intensity characteristics based on digital signals.

In the present invention, it is preferable that the ON resistance of the thin film transistors is lower than the ON resistance of the luminescent elements, while the OFF resistance of the thin film transistors is higher than the OFF resistance of the luminescent elements. With this arrangement, the ON state and the OFF state of the luminescent elements can be switched by switching the ON state and the OFF state of the thin film transistors. More preferably, the ON resistance of the thin film transistors is so low that it may be ignored, as compared with the ON resistance of the luminescent elements. At this time, the current passed through the luminescent elements is determined only by the ON resistance of the luminescent elements, so that it is independent of some increase or decrease in the ON resistance of the thin film transistors. This suppresses the nonuniformity in the luminous intensity resulting from the nonuniformity of the conductance of the transistors. Further preferably, the OFF resistance of the thin film transistors is far higher than the OFF resistance of the luminescent elements. Thus, the luminescent elements can be securely placed in the OFF state.

In the present invention, the thin film transistors are preferably the polycrystalline silicon thin film transistors produced at a low temperature process at 600 degrees Celsius or lower. This makes it possible to implement larger areas at low cost and also to achieve such features as high mobility for enabling the drive of the luminescent elements and high reliability.

In the present invention, the luminescent elements are preferably the organic electroluminescent elements produced by an ink-jdt process. With this arrangement, it is possible to pattern an organic electroluminescent element, which achieves outstanding characteristics including high luminous efficiency and long service life, on a panel.

DETAIL DESCRIPTION OF THE PREFERRED EMBODIMENT

Embodiments of the present invention will be described with reference to the accompanying drawings.

(First Embodiment)

Figure 1:
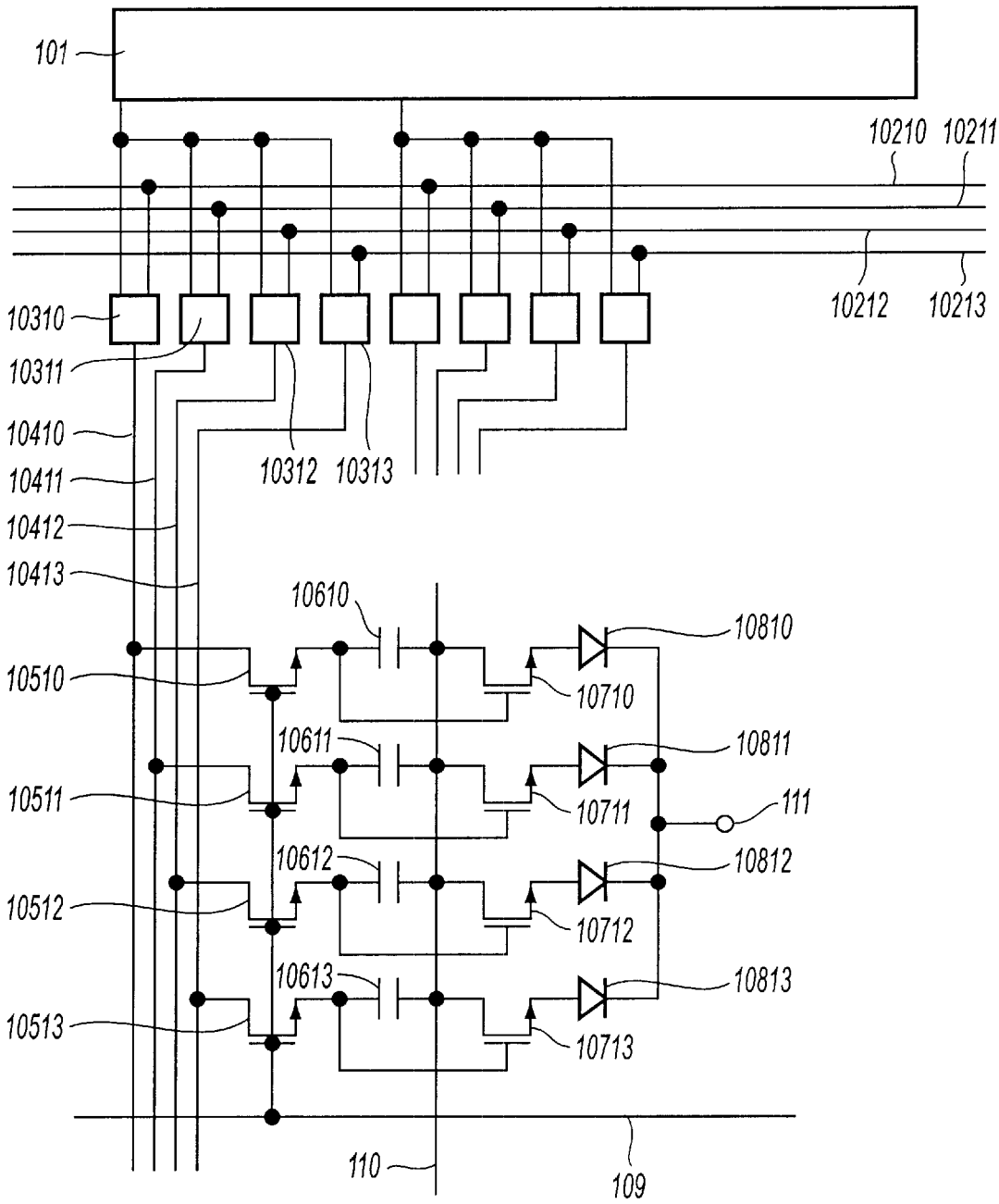
FIG. 1 is an equivalent circuit diagram of a TFT-OELD of a first embodiment in accordance with the present invention.

FIG. 1 is an equivalent circuit diagram of a TFT-OELD of a first embodiment in accordance with the present invention. Although only one pixel is shown in the drawing, there are many pixels arranged in a plurality of rows and a plurality of columns in an actual device.

When a pulse is output from a shift register 101, digital signals of digital signal supply lines 10210 through 10213 of zero-th through third bits are transmitted to source lines 10410 through 10413 via transmission switches 10310 through 10313 of the zero-th through third bits. In other words, the digital signals are transmitted to each pixel. For a gate line 109 that has been selected at this time, the digital signals are respectively transmitted to retention capacitors 10610 through 10613 of the zero-th through third bits via switching transistors 10510 through 10513 of the zero-th through third bits, respectively. Current transistors 10710 through 10713, which are thin film transistors, and organic EL elements 10810 through 10813, which are current elements, are respectively connected in series. Hence, the ON/OFF control of the current transistors 10710 through 10713 of the zero-th through third bits are conducted by the digital signals so that the organic EL elements 10810 through 10813 of the zero-th through third bits emit light or emit no light in response to the digital signals.

Figure 2:
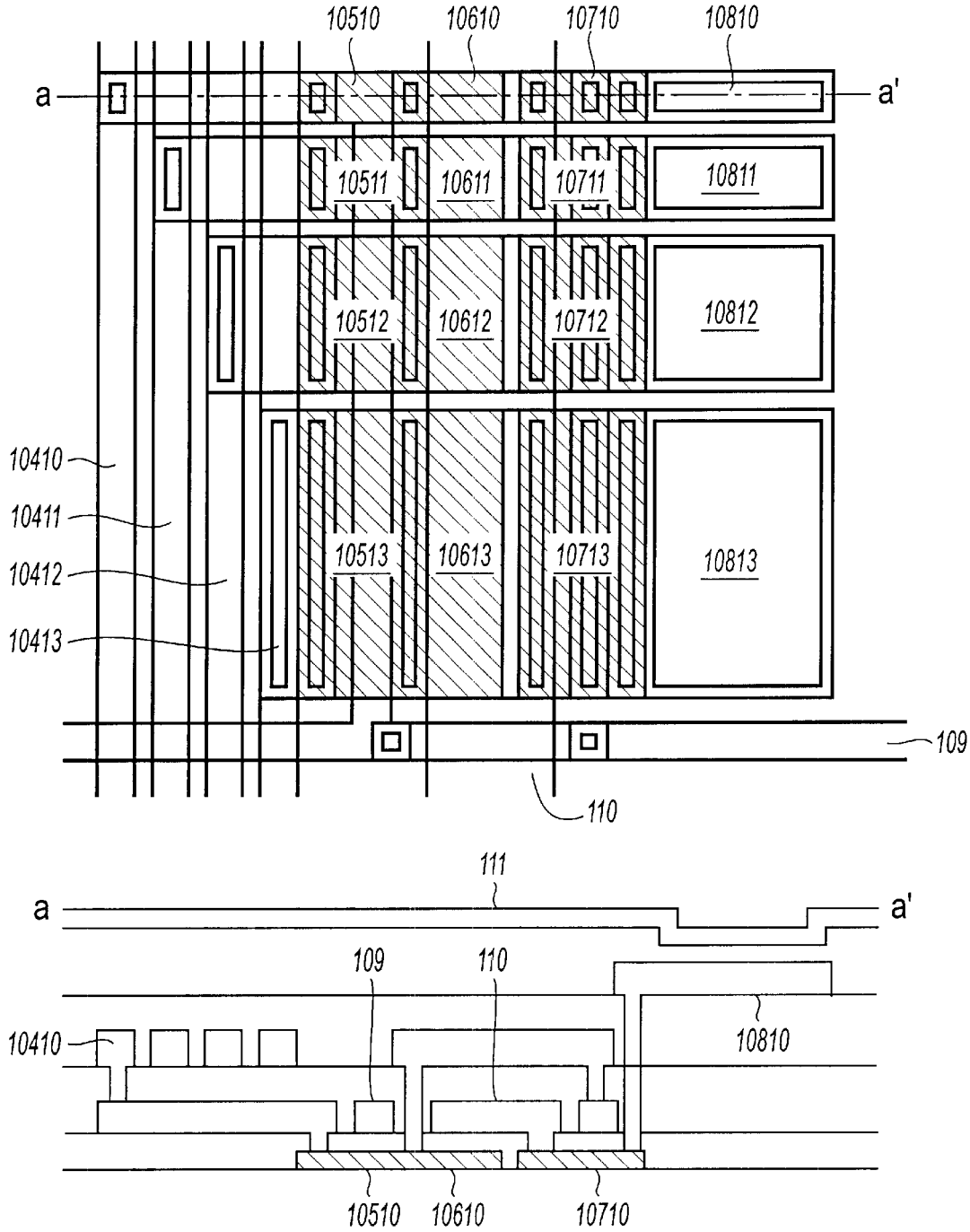
FIG. 2 provides a top plan view and a sectional view of the TFT-OELD of the first embodiment in accordance with the present invention.

FIG. 2 provides a top plan view and a sectional view of the TFT-OELD of the first embodiment in accordance with the present invention.

The organic EL elements 10810 through 10813 of the zero-th through third bits, which are luminescent elements, have different areas to provide different luminous intensity levels, permitting the so-called area gray scale method to be implemented. In addition, the areas or the luminous intensities are set to the geometric progressions of a common ratio of 2 so as to provide each pixel with a DA converter.

In this embodiment, a polycrystalline silicon thin film transistors that have been produced at a low-temperature process of 600 degrees Celsius or below are used as the thin film transistors making up the shift register 101, the transmission switches 10310 through 10313 of the zero-th through third bits, the switching transistors 10510 through 10513 of the zero-th through third bits, and the current transistors 10710 through 10713, etc.; however, other elements may be used as long as they have equivalent functions. The organic semiconductor films constituting the organic EL elements 10810 through 10813 of the zero-th through third bits are formed using the so-called ink-jet process in which a liquid material is discharged from an ink-jet head; however, current luminescent elements formed by a different process or current luminescent elements other than the organic EL elements may be employed instead.

Figure 3:
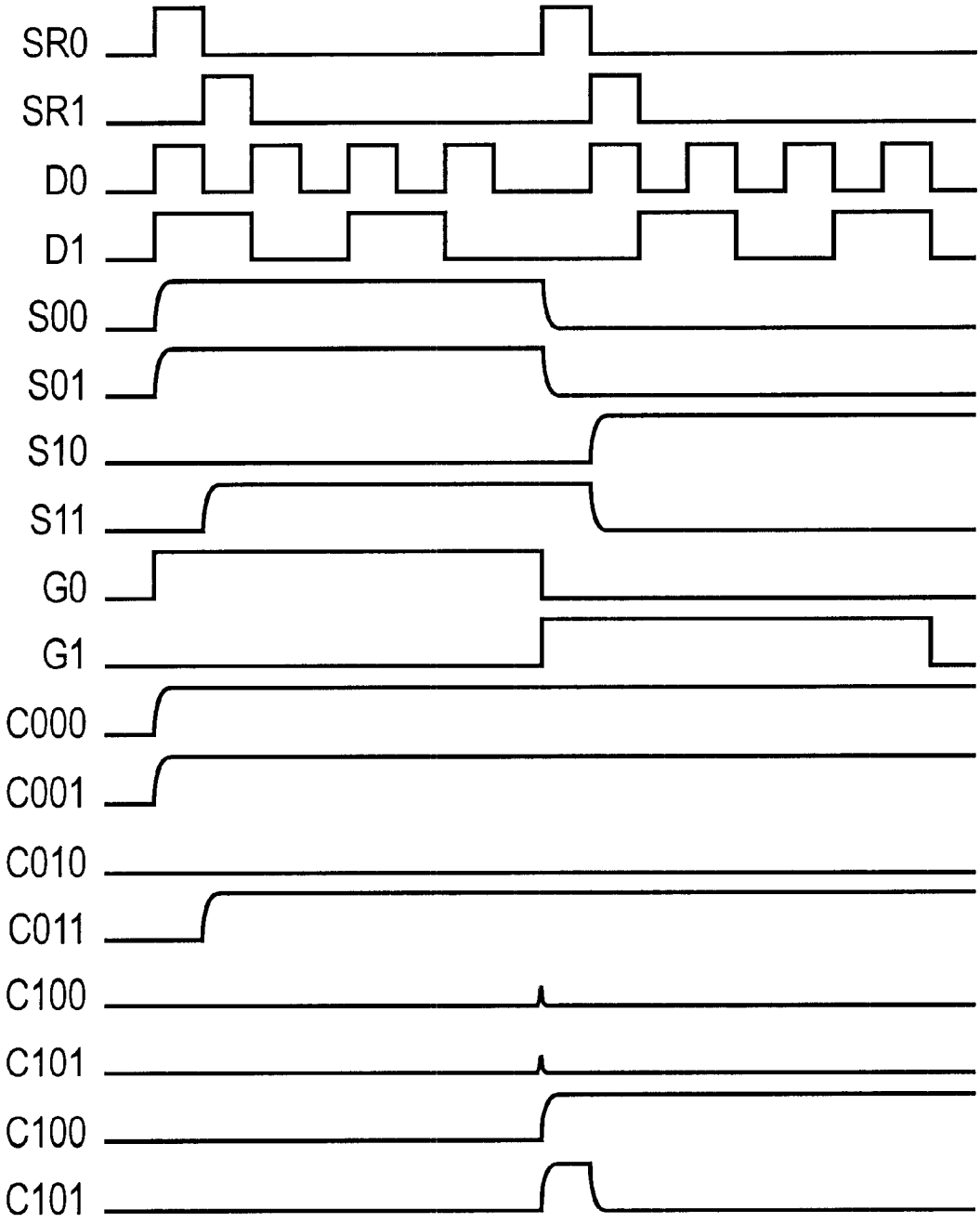
FIG. 3 is a view showing a driving method for the TFT-OELD of the first embodiment in accordance with the present invention.

FIG. 3 illustrates the driving method of the TFT-OELD of the first embodiment in accordance with the present invention.

A pulse SR0 of a shift register of a zero-th column causes digital signals D0 and D1 of the zero-th and first bits to be transmitted to potentials S00 and S01 of source lines of the zero-th and first bits in the zero-th column. Further, a pulse SR1 of a shift register of a first column causes the digital signals D0 and D1 of the zero-th and first bits to be transmitted to potentials S10 and S11 of source lines of the zero-th and first bits in the first column. While a pulse G0 of a gate line of the zero-th row is being applied, potentials S00 and S01 of source lines of the zero-th and first bits in the zero-th column are transmitted to potentials C000 and C001 of retention capacitors of the zero-th and first bits in the zero-th row and the zero-th column, while potentials S10 and S11 of source lines of the zero-th and first bits in the first column are transmitted to potentials C010 and C011 of retention capacitors of the zero-th and first bits in the zero-th row and the zero-th column. Then, while a pulse of a first-row gate line is being applied, potentials S00 and S01 of the source lines of the zero-th and first bits in the zero-th column are transmitted to potentials C100 and C101 of retention capacitors of the zero-th and first bits in the first row and the zero-th column, while potentials S10 and S11 of the source lines of the zero-th and first bits in the first column are transmitted to potentials C110 and C111 of retention capacitors of the zero-th and first bits in the first row and the first column. The respective organic EL elements emit light or emit no light in accordance with the potentials of the respective retention capacitors, i.e., the corresponding digital signals.

In this case, the resistance of the current transistors in the ON state is sufficiently small to ignore as compared with that of the organic EL elements in the ON state. Hence, the current passing through the organic EL elements depends only on the resistance of the organic EL elements with respect to the voltage between a common electrode 110 and an upper electrode 111, and it is independent from some increase or decrease in the resistance of the current transistors. Hence, the nonuniformity in the luminous intensity caused by the nonuniformity in the conductance of the transistors can be suppressed. Further, the resistance of the current transistors in the OFF state is extremely higher than the resistance of the organic EL elements in the OFF state. This makes it possible to securely put the organic EL elements in the OFF state.

(Second Example)

Figure 4:
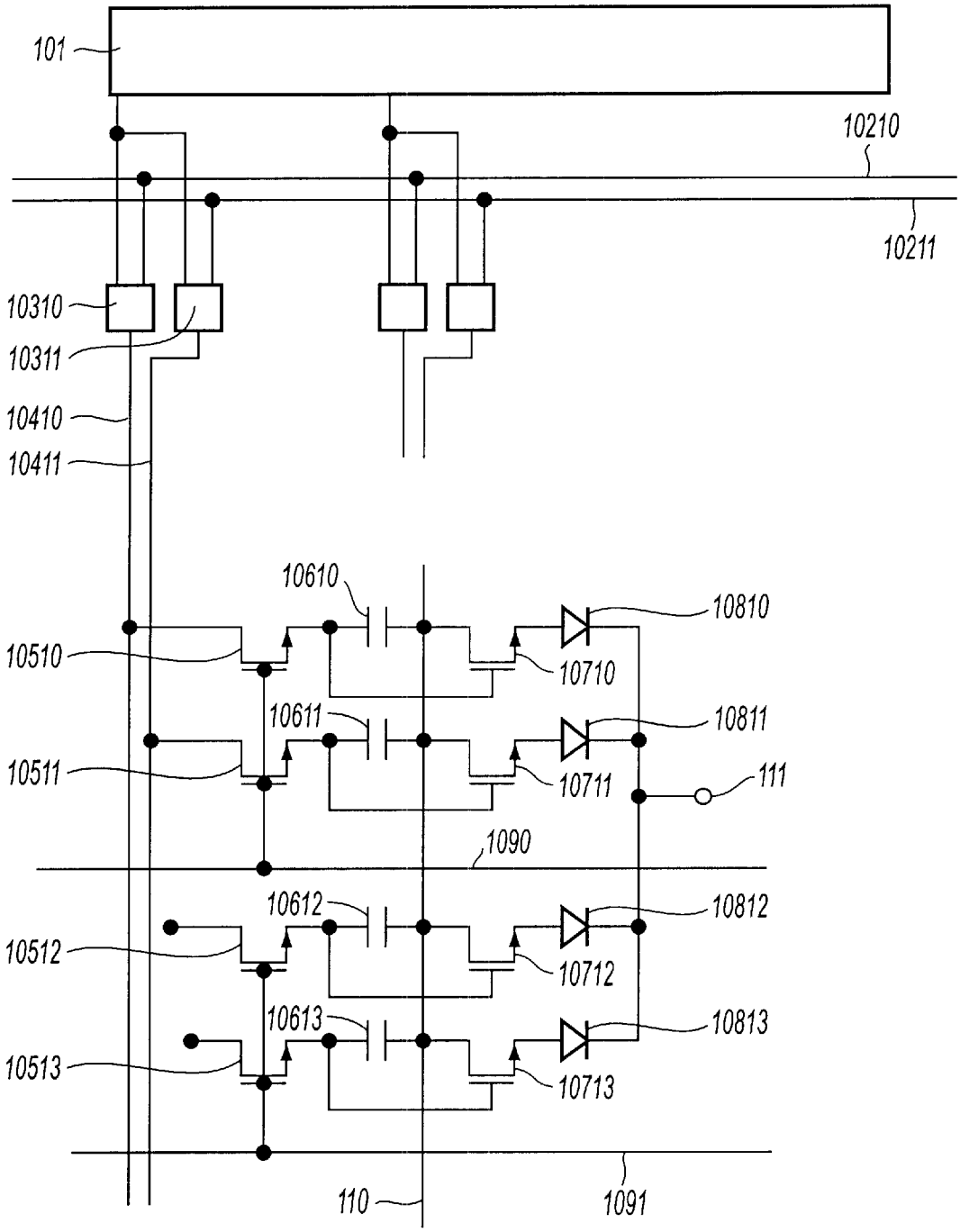
FIG. 4 is an equivalent circuit diagram of a TFT-OELD of a second embodiment in accordance with the present invention.
Figure 5:
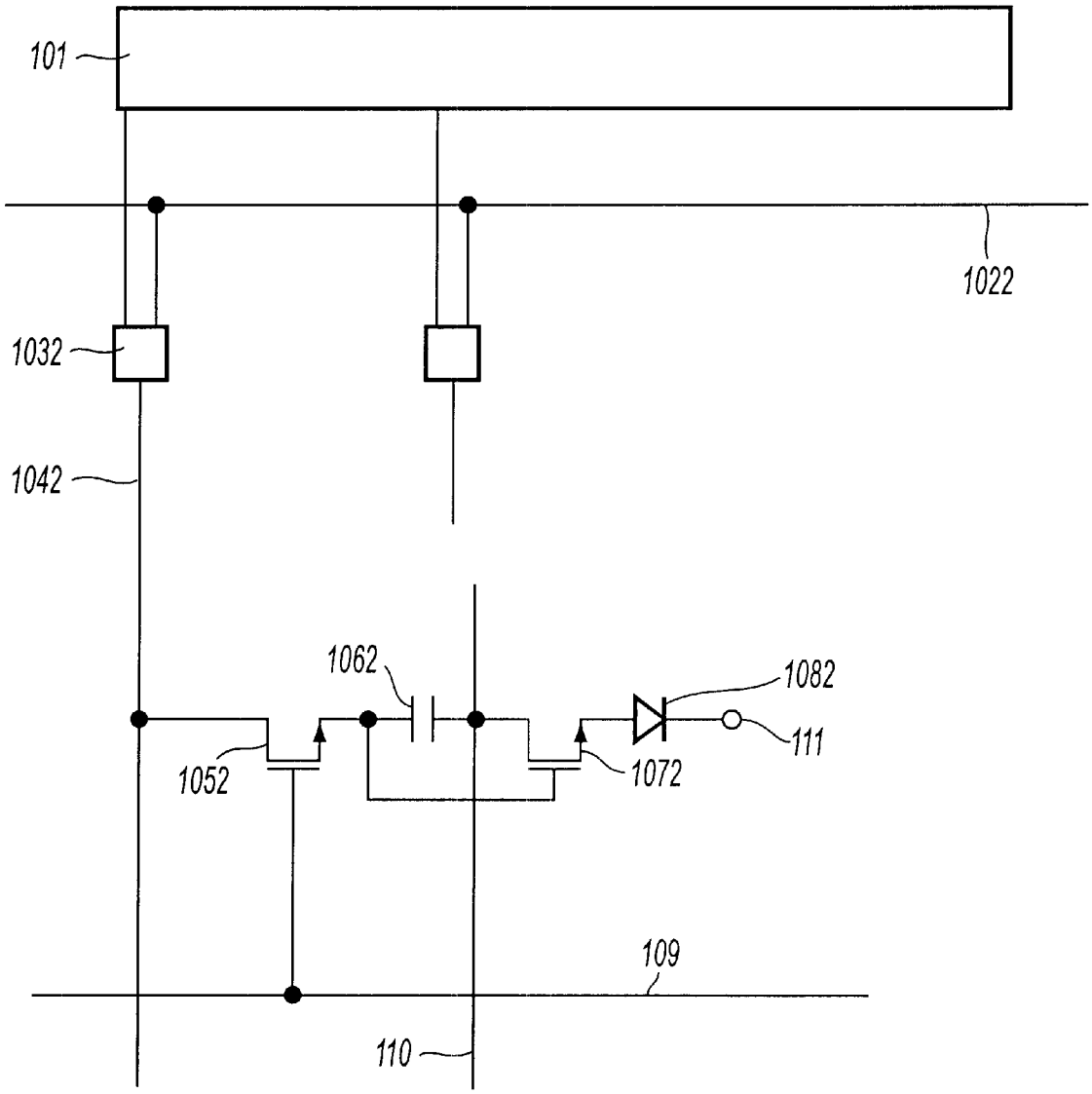
FIG. 5 is an equivalent circuit of a conventional TFT-OELD.
Figure 6:
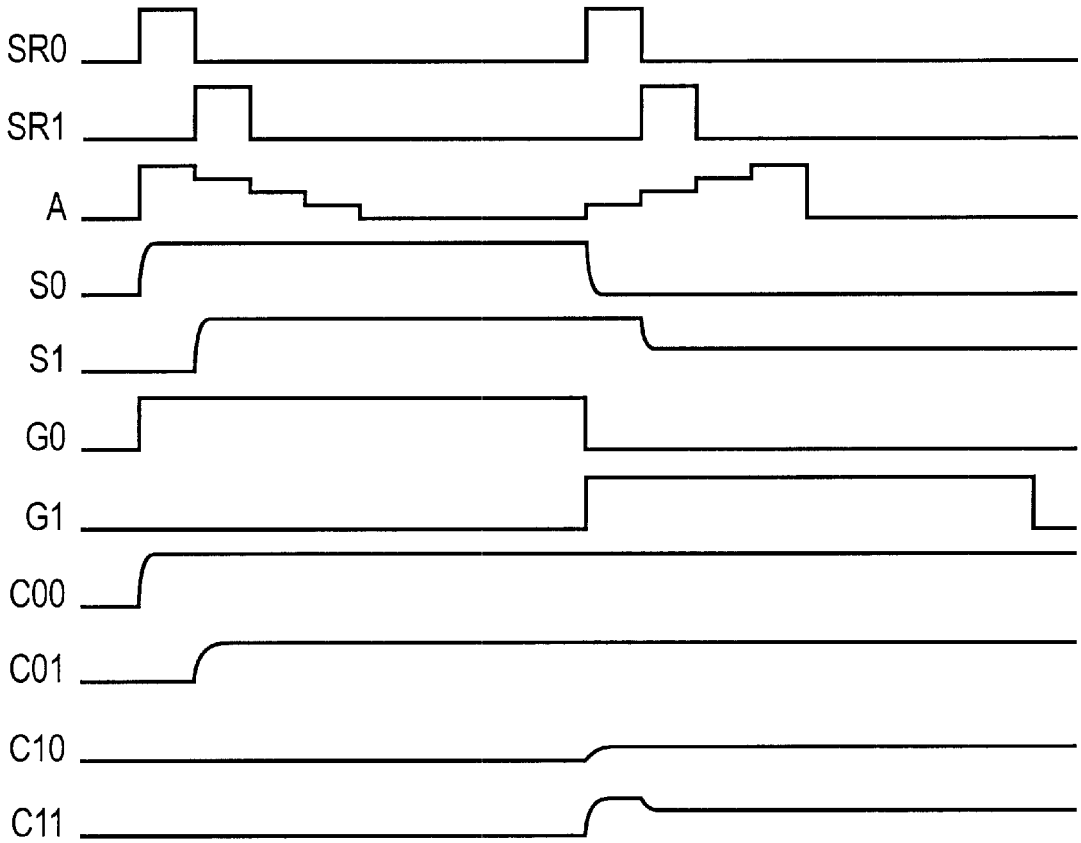
FIG. 6 is a diagram illustrative of a driving method for the conventional TFT-OELD.

FIG. 4 is an equivalent circuit diagram of a TFT-OELD of a second embodiment in accordance with the present invention.

The operations, functions, and advantages of the TFT-OELD of this embodiment are almost identical to those of the first embodiment. In this embodiment, however, a gate line 109 is divided into a gate line 1090 for lower-order bits that is assigned the functions of zero-th and first bits and a gate line 1091 for higher-order bits that is assigned the functions of second and third bits. This makes it possible to reduce the number of the digital supply lines and the number of the transmission switches and source lines per column from four to two. However, the frequencies of the scanning signals of the gate lines, the pulses of the shift register, and the digital signals will be doubled.

(Application Example)

The present invention is intended to reduce the nonuniformity in the luminous intensity of luminescent elements caused by the nonuniformity in the conductance of transistors in a current luminescent display element and therefore it is intrinsically different from the area gray scale method of the liquid crystal display element mentioned in "Background Art." In fact, current luminescent display elements do not even need to have different areas as long as they have different luminous intensity levels. Their structures, however, have similar aspects. Therefore, many embodiments disclosed in relation to the area gray scale method of liquid crystal display elements can be applied to the gray scale method in accordance with the present invention, and the similar advantages to those of the disclosed embodiments can be expected.

Industrial Applicability

Having the advantages described above, the present invention is ideally used with a display device equipped with elements that emit light by means of thin film transistors and current. As the light emitting elements, organic electroluminescent elements, for example, can be used. Further, a display device to which the present invention has been applied can be used not only for a personal computer for personal use, and a portable electronic pocketbook but also for information display equipment including an outdoor large bulletin board and an advertisement signboard.

What is claimed is:

1. A display device, comprising:

a shift register;

a plurality of digital signal supply lines;

a plurality of scanning lines;

a plurality of signal-line sets, each of the plurality of signal-line sets comprising a plurality of bit signal lines, the number of the bit signal lines being the same as that of the plurality of digital signal supply lines;

a plurality of transmission-switch sets, each transmission-switch set of the plurality of transmission switch sets comprising a plurality of transmission switches, the plurality of transmission switches being controlled together by one pulse of the shift register, each of the plurality of transmission switches controlling transmission of signals from one digital signal supply line of the plurality of digital signal supply lines to one bit signal line of the plurality of bit signal lines corresponding to the one digital signal supply line; and a plurality of pixels, each of the plurality of pixels comprising:

a plurality of current transistors;

a plurality of luminescent elements, each of the plurality of luminescent elements being connected with one of the plurality of current transistors in series, the plurality of luminescent elements having different areas so that the luminous intensities of the respective luminescent elements within each of the pixels are different;

a plurality of switching transistors, the plurality of switching transistors being controlled by one of the plurality of scanning lines, and at least one of a source and a drain of each of the plurality of switching transistors being connected to corresponding bit signal lines of the plurality of bit signal lines; and a plurality of retention capacitors, each of the plurality of retention capacitors receiving signals through a corresponding switching transistor of the plurality of switching transistors and a corresponding bit signal line of the plurality of bit signal lines.

2. The display device according to claim 1, each of the luminescent elements taking any one of an emissive state and a non-emissive state.

3. The display device according to claim 1, luminous intensities of the luminescent elements for each of the pixels being geometric progressions of a common ratio of 2.

4. The display device according to claim 1, an ON resistance of the current transistors being lower than an ON resistance of the luminescent elements, and an OFF resistance of the current transistors being higher than an OFF resistance of the luminescent elements.

5. The display device according to claim 1, the current transistors being polycrystalline silicon thin film transistors produced at a low temperature process at 600 degrees Celsius or below.

6. The display device according to claim 1, the luminescent elements being organic electroluminescent elements produced by an ink-jet process.

7. The display device according to claim 1, each of the pixels corresponding to four of the luminescent elements.

8. The display device according to claim 1, the areas of the luminescent elements for each of the pixels being geometric progressions of a common ratio of 2.

9. A display device, comprising:

a shift register;

a plurality of digital signal supply lines;

a plurality of scanning lines;

a plurality of signal-line sets, each of the plurality of signal-line sets comprising a plurality of bit signal lines, a number of the bit signal lines being same as that of the plurality of digital signal supply lines;

a plurality of transmission-switch sets, each transmission-switch set of the plurality of transmission switch sets comprising a plurality of transmission switches, the plurality of transmission switches being controlled together by one pulse of the shift register, each of the plurality of transmission switches controlling transmission of signals from one digital signal supply line of the plurality of digital signal supply lines to one bit signal line of the plurality of bit signal lines corresponding to the one digital signal supply line; and a plurality of pixels, each of the plurality of pixels comprising:

a plurality of current transistors;

a plurality of luminescent elements, each of the plurality of luminescent elements being connected with one of the plurality of current transistors;

a plurality of switching transistors, the plurality of switching transistors being controlled by one of the plurality of scanning lines, and at least one of a source and a drain of each of the plurality of switching transistors being connected to a corresponding bit signal line of the plurality of bit signal lines; and a plurality of retention capacitors, each of the plurality of retention capacitors receiving signals through a corresponding switching transistor of the plurality of switching transistors and a corresponding bit signal line of the plurality of bit signal lines.

10. A display device, comprising:

a shift register;

a plurality of digital signal supply lines;

a plurality of scanning lines;

a plurality of signal-line sets, each of the plurality of signal-line sets comprising a plurality of bit signal lines, a number of the bit signal lines being same as that of the plurality of digital signal supply lines;

a plurality of transmission-switch sets, each transmission-switch set of the plurality of transmission switch sets comprising a plurality of transmission switches, the plurality of transmission switches being controlled together by one pulse of the shift register, each of the plurality of transmission switches controlling transmission of signals from one digital signal supply line of the plurality of digital signal supply lines to one bit signal line of the plurality of bit signal lines corresponding to the one digital signal supply line; and a plurality of pixels, each of the plurality of pixels comprising:

a plurality of current transistors;

a plurality of luminescent elements, each of the plurality of luminescent elements being connected with one of the plurality of current transistors, and luminous intensities of the luminescent elements being different from each other;

a plurality of switching transistors, the plurality of switching transistors being controlled by one of the plurality of scanning lines, and at least one of a source and a drain of each of the plurality of switching transistors being connected to a corresponding bit signal line of the plurality of bit signal lines; and a plurality of retention capacitors, each of the plurality of retention capacitors receiving signals through a corresponding switching transistor of the plurality of switching transistors and a corresponding bit signal line of the plurality of bit signal lines.

11. A display device, comprising:

a shift register;

a plurality of digital signal supply lines;

a plurality of scanning lines;

a plurality of signal-line sets, each of the plurality of signal-line sets comprising a plurality of bit signal lines, a number of the bit signal lines being same as that of the plurality of digital signal supply lines;

a plurality of transmission-switch sets, each transmission-switch set of the plurality of transmission switch sets comprising a plurality of transmission switches, the plurality of transmission switches being controlled together by one pulse of the shift register, each of the plurality of transmission switches controlling transmission of signals from one digital signal supply line of the plurality of digital signal supply lines to one bit signal line of the plurality of bit signal lines corresponding to the one digital signal supply line; and a plurality of pixels, each of the plurality of pixels comprising:

a plurality of current transistors;

a plurality of luminescent elements, each of the plurality of luminescent elements being connected with one of the plurality of current transistors, areas of the plurality of luminescent elements being different from each other;

a plurality of switching transistors, the plurality of switching transistors being controlled by one of the plurality of scanning lines, and at least one of a source and a drain of each of the plurality of switching transistors being connected to a corresponding bit signal line of the plurality of bit signal lines; and a plurality of retention capacitors, each of the plurality of retention capacitors receiving signals through a corresponding switching transistor of the plurality of switching transistors and a corresponding bit signal line of the plurality of bit signal lines.

* * * * *